US008479846B2

(12) United States Patent
Huynh et al.

(10) Patent No.: US 8,479,846 B2
(45) Date of Patent: Jul. 9, 2013

(54) EARTH-BORING TOOLS INCLUDING AN IMPACT MATERIAL AND METHODS OF DRILLING THROUGH CASING

(75) Inventors: Trung Quoc Huynh, Houston, TX (US); Calvin J. Stowe, West University Place, TX (US); Andrew D. Ponder, Houston, TX (US); James S. Trahan, Magnolia, TX (US)

(73) Assignee: Baker Hughes Incorporated, Boise, ID (US)

( * ) Notice: Subject to any disclaimer, the term of this patent is extended or adjusted under 35 U.S.C. 154(b) by 330 days.

(21) Appl. No.: 12/499,968

(22) Filed: Jul. 9, 2009

(65) Prior Publication Data

US 2010/0012387 A1 Jan. 21, 2010

Related U.S. Application Data

(60) Provisional application No. 61/080,976, filed on Jul. 15, 2008.

(51) Int. Cl.
*E21B 10/36* (2006.01)

(52) U.S. Cl.
USPC ..... 175/428; 175/408; 175/407; 175/425

(58) Field of Classification Search
USPC ..... 175/57, 426, 428, 407, 380, 424, 175/420.1, 370, 432, 431; 228/176; 166/298
See application file for complete search history.

(56) References Cited

U.S. PATENT DOCUMENTS

| | | | | |
|---|---|---|---|---|
| 2,846,193 | A * | 8/1958 | Chadderdon | 166/55.7 |
| 4,889,017 | A * | 12/1989 | Fuller et al. | 76/108.2 |
| 4,949,795 | A | 8/1990 | McDonald et al. | |
| 6,151,960 | A * | 11/2000 | Taylor et al. | 73/152.52 |
| 6,481,511 | B2 | 11/2002 | Matthias et al. | |
| 6,568,492 | B2 * | 5/2003 | Thigpen et al. | 175/408 |
| 6,742,611 | B1 | 6/2004 | Illerhaus et al. | |
| 6,883,623 | B2 | 4/2005 | McCormick et al. | |
| 7,373,997 | B2 | 5/2008 | Kembaiyan et al. | |
| 7,954,571 | B2 | 6/2011 | Mcclain et al. | |
| 2005/0183892 | A1 * | 8/2005 | Oldham et al. | 175/402 |
| 2006/0070771 | A1 | 4/2006 | McClain et al. | |
| 2006/0157279 | A1 | 7/2006 | Cariveau et al. | |
| 2007/0079995 | A1 | 4/2007 | McClain et al. | |

OTHER PUBLICATIONS

International Search Report for International Application No. PCT/US2009/050011 mailed Feb. 12, 2010, 4 pages.
Written Opinion for International Application No. PCT/US2009/050011 mailed Feb. 12, 2010, 4 pages.

* cited by examiner

*Primary Examiner* — Yong-Suk (Philip) Ro
(74) *Attorney, Agent, or Firm* — TraskBritt

(57) ABSTRACT

Earth-boring tools comprise a face and a plurality of cutting elements disposed on at least a portion of the face. An impact material is positioned on at least one portion of a body and has a relative exposure equal to or greater than at least some of the cutting elements of the plurality of cutting elements. The impact material comprises a material having a lower abrasion resistance than the body. Methods of making and methods of using such earth-boring tools.

21 Claims, 2 Drawing Sheets

EARTH-BORING TOOLS INCLUDING AN IMPACT MATERIAL AND METHODS OF DRILLING THROUGH CASING

CROSS-REFERENCE TO RELATED APPLICATION

This application claims benefit to U.S. Provisional Patent Application Ser. No. 61/080,976, filed Jul. 15, 2008, the disclosure of which is incorporated herein by reference in its entirety.

TECHNICAL FIELD

Embodiments of the present disclosure relate generally to earth-boring tools and, more specifically, to earth-boring tools for having a capability for drilling in high-vibration environments, including when drilling through casing or liner string and/or casing components, as well as the use and manufacture of such tools.

BACKGROUND

Drilling wells for oil and gas production conventionally employs longitudinally extending sections, or so-called "strings," of drill pipe to which, at one end, is secured a drill bit of a larger diameter. After a selected portion of the bore hole has been drilled, a string of tubular members of lesser diameter than the bore hole, known as casing, is placed in the bore hole. Subsequently, the annulus between the wall of the bore hole and the outside of the casing is filled with cement before the well is produced. During the drilling of the bore hole, it is often desirable to drill a directional hole, or bore hole, through the side of the casing at an angle to the original bore hole. Such "sidetracking" operations are performed for several reasons, such as avoiding, or drilling around a component that has been previously positioned or become stuck in the casing. In addition, such operations make it possible to drill several so-called "lateral" wells from the original bore hole location.

Many directional drilling techniques include setting an orienting tool such as a whipstock in the bore hole within the casing at a desired depth. A whipstock has an inclined upper face, or ramp, which directs a drilling tool into the sidewall of the casing in the original well bore. Typically, whipstock ramps are comprised of a difficult-to-drill, smooth-surfaced material so as to be more effective in guiding a rotating drilling tool against the casing. Similarly, the casing is typically comprised of a robust, drillable iron-based material such as, for example, a high strength alloy steel. When the whipstock is set in place, a rotating window mill or other drilling tool typically is employed that follows the curve of the whipstock through the casing sidewall. When the rotating drilling tool engages the inner surface of the sidewall of the casing and is essentially wedged between the whipstock ramp and the casing, the drilling tool will often experience a substantial degree of high-amplitude vibration initially as any cutting elements thereon run across and transition between contact with the hard whipstock ramp material and the casing material. These vibrations typically subside once the drilling tool has sufficiently established a cutting pattern in the casing wall. In many cases, this initial, harsh vibration may cause superabrasive cutting elements on the drilling tool to spall or even fracture, and fail prematurely prior to even substantially engaging the casing material and the formation material exterior to the casing.

To enable effective drilling of casing, it would be desirable to have a drill bit or tool offering the capability of protecting the cutting elements upon initially contacting the casing to enable the cutting elements to drill through the casing and subsequent exterior formation material once the casing has been adequately engaged.

BRIEF SUMMARY

Various embodiments of the present disclosure comprise earth-boring tools configured for use in high vibration environments. In one or more embodiments, such an earth-boring tool may include a body comprising a face. A plurality of cutting elements may be positioned over the face of the body. An impact material may be positioned on at least one portion of the body. The impact material may comprise a material having a lower abrasion resistance than the body and may be disposed having a relative exposure substantially equal to, or greater than at least some cutting elements of the plurality of cutting elements.

Other embodiments comprise methods for drilling material of a casing disposed in a subterranean formation. One or more embodiments of such methods may comprise directing a rotating earth-boring tool toward an inner surface of a casing. The earth-boring tool may comprise an impact material positioned on at least one portion of a body of the earth-boring tool. The impact material may have a lower abrasion resistance than the body and a relative exposure substantially equal to, or greater than a plurality of cutting elements disposed on the body. During rotation, the inner surface of the casing may engage with at least the impact material positioned on the at least one portion of the body. The impact material may be worn away responsive to engagement of the impact material with the inner surface of the casing as the earth-boring tool cuts into the surface of the casing.

Additional embodiments comprise methods of making earth-boring tools. One or more embodiments of such methods may comprise forming a body comprising a face at a leading end thereof and having a shank connected thereto at a trailing end thereof. A plurality of cutting elements may be positioned on at least a portion of the body. An impact material may be disposed on at least one portion of the body to a relative exposure substantially equal to, or greater than at least some of the plurality of cutting elements. The impact material may comprise a material having a lower abrasion resistance than the body.

DETAILED DESCRIPTION

The illustrations presented herein are, in some instances, not actual views of any particular impact material or drill bit, but are merely idealized representations that are employed to describe the present disclosure. Additionally, elements common between figures may retain the same numerical designation.

Various embodiments of the present disclosure comprise earth-boring tools comprising an area of material positioned thereon to engage a portion of casing or formation material before any cutting elements on the earth-boring tool engage the casing or formation material.

Figure 1:
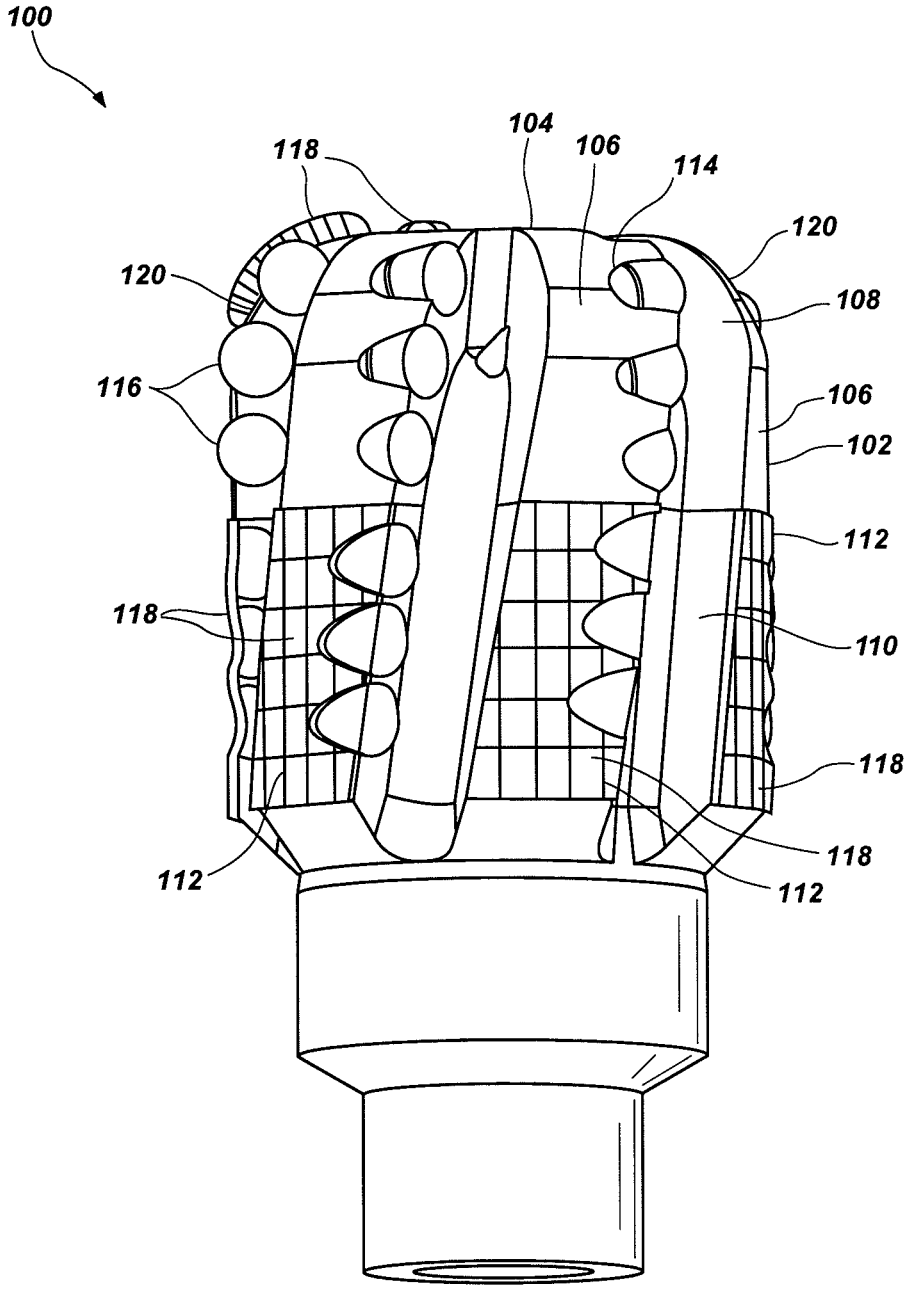
FIG. 1 is an elevation view of a drill bit according to at least one embodiment.
Figure 2:
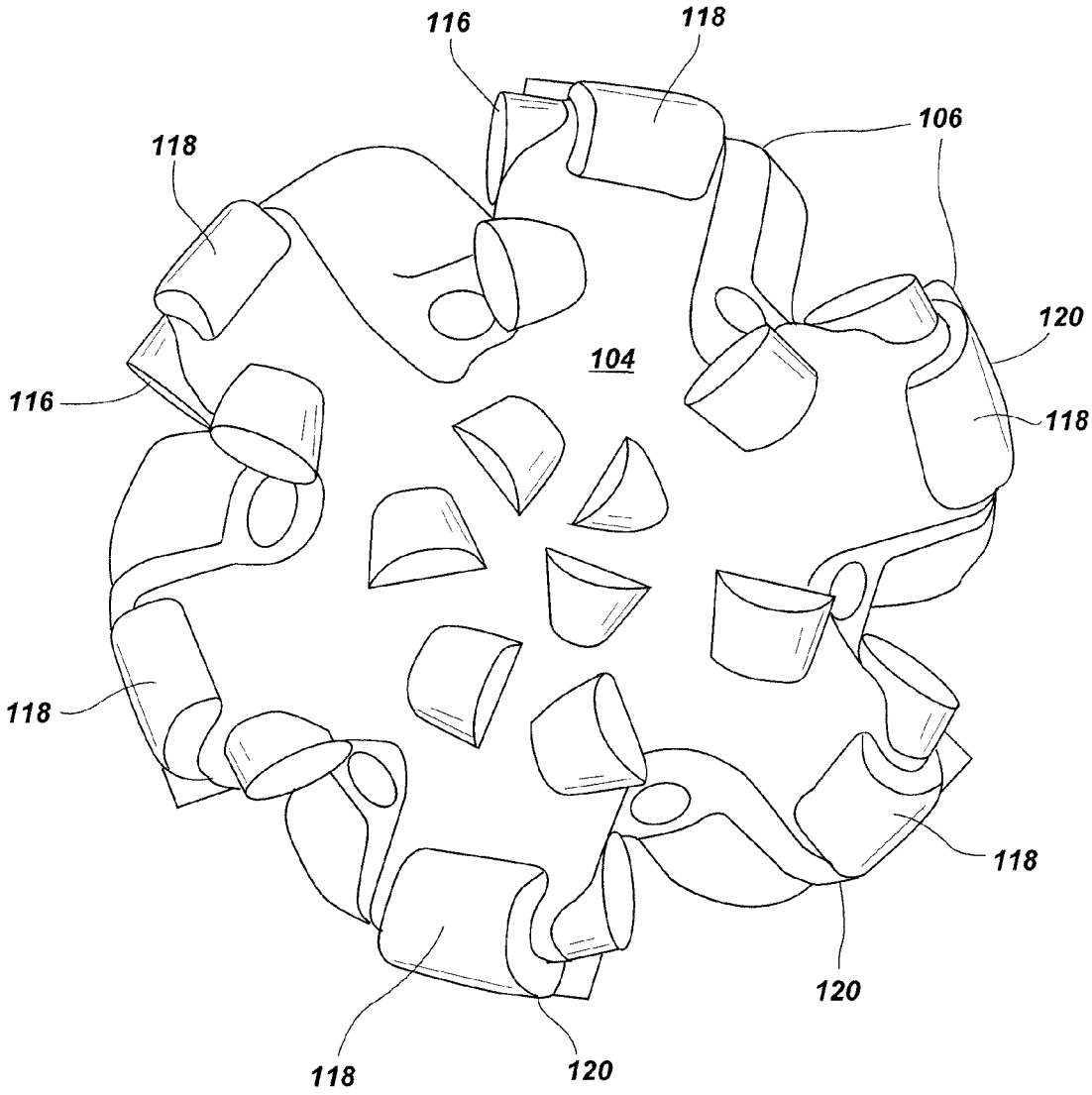
FIG. 2 is a plan view of a drill bit according to at least one embodiment.

Referring to FIGS. 1 and 2, a drill bit in the form of a fixed-cutter or so-called "drag bit," according to embodiments of the present disclosure are illustrated. Drill bit 100 includes a body 102 having a face 104 and generally radially extending blades 106, forming fluid courses 108 therebetween extending to junk slots 110 between circumferentially adjacent blades 106. Bit body 102 may comprise a tungsten carbide matrix or a steel body, both being well known in the art.

Blades 106 may include a gage region 112 that is configured to define the outermost radius of the drill bit 100 and, thus, the radius of the wall surface of a bore hole drilled thereby. Gage regions 112 comprise longitudinally upward (as the drill bit 100 is oriented during use) extensions of blades 106.

Drill bit 100 may also be provided with pockets 114 in blades 106, which may be configured to receive cutting elements 116. Cutting elements 116 are configured to be capable of cutting through casing and/or subterranean formations. Cutting elements 116 may, therefore, comprise a diamond table portion suitable for drilling through casing and/or subterranean features. As used herein, the term "diamond table" is non-limiting of the physical configuration of the diamond portion of the cutting element, and encompasses both single crystal diamond, diamond-to-diamond bonded aggregates of diamond grit in the form of so-called "polycrystalline diamond" (PDC) and thermally stable polycrystalline diamond, termed "TSPs" (indicating thermally stable products) as well as structures of a hard material, for example, a carbide, impregnated with natural diamond or synthetic diamond grit, or a combination thereof. Such structures are exemplified by so-called "impregnated segments" used on drag bits for extremely hard formation drilling. Combinations of the foregoing may also be employed. Further, the term "diamond table" means a structure of sufficient strength, impact and abrasion resistance to be suitable for cutting subterranean (rock) formations for substantial distances. Further, as used herein, the term "diamond" encompasses other superabrasive materials, including without limitation cubic boron nitride and diamond-like carbon.

Drill bit 100 is further provided with an impact material 118 positioned over one or more portions of the bit body 102. The impact material 118 may comprise a material configured to wear more quickly than the material comprising the bit body 102. The impact material 118 may also be configured to wear more quickly than a material covering a portion of an outer surface of the bit body 102 in various wear areas, such as a so-called "hardfacing" material. For example, the impact material 118 may comprise a material having lower abrasion resistance properties than the abrasion resistance properties of tungsten carbide in an alloy matrix, a metal alloy material, or a conventional hardfacing material. By way of example and not limitation, the impact material 118 may comprise a bronze, such as a silicon bronze or aluminum bronze, or another material having similar abrasion resistance properties.

Generally, the impact material 118 may be positioned in those areas or over those portions of the body 102 where initial impact between the drill bit 100 and the casing or formation material will likely occur when drilling, based on prior experience or mathematical modeling. By way of example and not limitation, some embodiments comprise a drill bit 100 configured for drilling through a casing wall. In such embodiments the use of a conventional whipstock to direct the drill bit 100 into the casing wall may generally angle the drill bit 100 such that at least one initial point of impact at which the drill bit 100 contacts the casing wall is the shoulder region 120. In such an embodiment, impact material 118 may be positioned on at least one blade 106 at the shoulder region 120. In another embodiment, impact material 118 may be positioned in the gage region 112. In still other embodiments, impact material 118 may be positioned in both the shoulder region 120 and the gage region 112. In another embodiment, the impact material 118 may be positioned on one or more portions of the face 104. It will be noted that these placements are not intended to be limiting. Indeed, impact material 118 may be positioned in a variety of different locations according to the specific bit body and face configuration, cutter placement, orientation and exposure, and drilling application.

In some embodiments, the impact material 118 may be configured as a structure having a specific shape. By way of example and not limitation, the impact material 118 may be shaped as a raised structure extending radially outward along one or more blades 106 and associated with one or more cutting elements 116. In some embodiments, the structure may be shaped in the form of one or more cutting structures having one or more cutting faces. In still other embodiments, the impact material 118 may be formed as a raised surface on the blade or gage region, as illustrated by the impact material 118 in the gage region 112 in FIG. 1.

In any of the contemplated configurations, the impact material 118 may be generally configured to provide structures and/or surfaces with a relative exposure at least substantially equal to, or greater than the exposure of the cutting elements 116. As used herein, the term "exposure" of a cutting element 116 or impact material 118 generally indicates its distance of protrusion above a portion of a drill bit, for example, a blade surface or the profile thereof, to which it is mounted. However, in reference specifically to the present disclosure, "relative exposure" is used to denote a difference in exposure between a cutting element 116 and the impact material 118. More specifically, the term "relative exposure" may be used to denote a difference in exposure between one cutting element 116 and a portion of impact material 118 that, optionally, may be proximately located in a direction of bit rotation and along the same or similar rotational path. In some embodiments, the impact material 118 may generally be described as rotationally "following" the cutting elements 116 and in close rotational proximity on the same blade 106. However, the impact material 118 may also be located to rotationally "lead" associated cutting elements 116, to fill an area between laterally adjacent cutting elements 116, or various combinations of any of the foregoing.

In some embodiments, the impact material 118 may be used in combination with one or more discrete cutters disposed on the face 104 of the drill bit 100, the one or more discrete cutters being different from, and in addition to the cutting elements 116. Some non-limiting examples of such cutters are described in U.S. Patent Publication No. 2007/0079995, and U.S. application Ser. No. 12/030,110, published as U.S. Patent Publication No. 2009/0084608, the disclosures of each of which are incorporated herein in their entirety by this reference. Such discrete, additional cutters are generally positioned to have a relative exposure greater than the primary cutting elements. Therefore, in embodiments in which such discrete cutters are employed, the impact material 118 may comprise a relative exposure greater than or equal to the relative exposure of the discrete cutters, to absorb the majority of the impact loads when the drill bit 100 first engages the casing or formation material to be drilled.

Additional embodiments of the present disclosure are directed to methods of forming earth-boring tools. Forming an earth-boring tool, according to some embodiments, may comprise forming a body 102 comprising a face 104 at a leading end thereof and a shank at a trailing end thereof. The body 102 may be formed from a metal or metal alloy, such as steel, or a particle-matrix composite material such as a tungsten carbide matrix material. In embodiments where the bit body 102 is formed of a particle-matrix composite material, the bit body 102 may be formed by conventional infiltration methods (in which hard particles (e.g., tungsten carbide) are infiltrated by a molten liquid metal matrix material (e.g., a copper-based alloy) within a refractory mold), as well as by newer methods generally involving pressing a powder mixture to form a green powder compact, and sintering the green powder compact to form a bit body 102. The green powder compact may be machined as necessary or desired prior to sintering using conventional machining techniques like those used to form steel bodies or steel plate structures. Indeed, in some embodiments, features (e.g., cutting element pockets, etc.) may be formed with the bit body 102 in a green powder compact state, or in a partially sintered brown body state. Furthermore, additional machining processes may be performed after sintering the green powder compact to the partially sintered brown state, or after sintering the green powder compact to a desired final density.

A plurality of cutting elements 116 may be disposed on the face 104 (e.g., in pockets 114 of one or more blades 106). The cutting elements 116 may be affixed upon the blades 106 of drill bit 100 by way of brazing, welding, adhesively, mechanically or as otherwise known in the art.

An impact material may be applied or disposed on the bit body 102 by conventional techniques suitable for the specific material used. According to at least some embodiments, the impact material may be disposed by welding the impact material onto the one or more surfaces of the bit body 102. By way of example and not limitation, in embodiments in which the impact material comprises a bronze material, such as a silicon bronze material, the bronze material may be disposed by welding a bronze welding wire and forming the material into the desired size and shape on the bit body 102. Any conventional welding process may be used, such as, by way of non-limiting example only, oxy-acetylene, MIG, TIG, SMA, SCA, PTA, etc.

Further embodiments of the present disclosure are directed to methods of drilling in high vibration environments. By way of example and not limitation, a drill bit 100 according to at least some embodiments may be used to drill through a portion of casing, such as a casing sidewall. In use, the drill bit 100 may be positioned into the bore hole and directed toward the sidewall of the casing. The drill bit 100 may be directed toward the sidewall of the casing by employing a whipstock or other known means. As the drill bit 100 rests against the whipstock, one or more portions of impact material 118 may be positioned on the drill bit 100 to initially engage the casing sidewall. Upon drilling into the casing sidewall, the impact material 118 may wear away to expose or more fully expose the cutting elements 116 and/or other cutting structures when present. In some embodiments, the impact material 118 may be substantially configured so that the material is sufficiently worn away to expose the cutting elements 116 and/or other cutting structures when the drill bit 100 has sufficiently established a cutting pattern in the casing. In some embodiments, the cutting pattern may be sufficiently established, and the impact material 118 is sufficiently worn away after the drill bit 100 has drilled about 5 inches (12.7 cm) into the casing sidewall. The drill bit 100 may then continue to drill through any remaining casing sidewall as well as formation material adjacent to the casing and beyond the casing.

While certain embodiments have been described and shown in the accompanying drawings, such embodiments are merely illustrative and not restrictive of the scope of the disclosure, and this disclosure is not limited to the specific constructions and arrangements shown and described, since various other additions and modifications to, and deletions from, the described embodiments will be apparent to one of ordinary skill in the art. Thus, the scope of the disclosure is only limited by the literal language, and legal equivalents, of the claims which follow.

What is claimed is:

1. An earth-boring tool, comprising:

a body comprising a face;

a plurality of cutting elements positioned over the face of the body; and an impact material positioned on at least one portion of the body and exhibiting a lower abrasion resistance than the body, wherein the impact material has a relative exposure greater than at least one cutting elements that is located along a substantially similar rotational path as the impact material.

2. The earth-boring tool of claim 1, wherein the impact material is positioned on at least one of a shoulder region and a gage region of the body.

3. The earth-boring tool of claim 1, wherein the impact material comprises bronze.

4. The earth-boring tool of claim 3, wherein the impact material comprises a copper alloy comprising aluminum or silicon.

5. The earth-boring tool of claim 1, wherein the impact material is configured as a cutting structure.

6. The earth-boring tool of claim 1, further comprising at least one discrete cutter, in addition to the plurality of cutting elements, positioned on body.

7. The earth-boring tool of claim 6, wherein the at least one discrete cutter has a greater relative exposure than at least some cutting elements of the plurality of cutting elements that is located along a substantially similar rotational path as the at least one discrete cutter.

8. The earth-boring tool of claim 7, wherein the impact material positioned on at least one portion of the body is positioned proximate the at least one discrete cutter along a substantially similar rotational path as the at least one discrete cutter and has a greater relative exposure than the exposure of the at least one discrete cutter.

9. The earth-boring tool of claim 1, further comprising a hardfacing material positioned between the impact material and at least a portion of the body underlying the impact material, the hardfacing material exhibiting a higher abrasion resistance than the impact material.

10. The earth-boring tool of claim 1, wherein the impact material has a relative exposure greater than at least some cutting elements of the plurality of cutting elements.

11. A method of drilling material of a casing disposed in a subterranean formation, comprising:

directing a rotating earth-boring tool toward an inner surface of a casing, the earth-boring tool comprising an impact material positioned on at least one portion of a body of the earth-boring tool, the impact material having a lower abrasion resistance than the body and a relative exposure greater than a relative exposure of a plurality of cutting elements disposed on the body and located along a substantially similar rotational path as the impact material;

during rotation, engaging the inner surface of the casing with at least the impact material positioned on the at least one portion of the body; and wearing away the impact material responsive to engagement thereof with the inner surface of the casing as the earth-boring tool cuts into the inner surface of the casing.

12. The method of claim 11, wherein directing the rotating earth-boring tool toward the inner surface of the casing comprises employing a whipstock to direct the rotating earth-boring tool toward the inner surface of the casing.

13. The method of claim 11, wherein engaging the inner surface of the casing with the impact material comprises engaging the inner surface of the casing with the impact material positioned on a shoulder region of the body.

14. The method of claim 11, wherein wearing away the impact material as the earth-boring tool cuts into the surface of the casing comprises wearing away the impact material to expose at least one of another cutting structure and the plurality of cutting elements.

15. The method of claim 14, wherein wearing away the impact material to expose at least one of another cutting structure and the plurality of cutting elements comprises wearing away the impact material to expose the at least one of another cutting structure and the plurality of cutting elements when the earth-boring tool has cut about 5 inches (12.7 cm) into the casing.

16. The method of claim 11, further comprising continuing to drill into the subterranean formation outside of the casing.

17. A method of drilling material of a casing disposed in a subterranean formation, comprising:

directing a rotating earth-boring tool toward an inner surface of a casing, the earth-boring tool comprising an impact material positioned on at least one portion of a body of the earth-boring tool, the impact material having a lower abrasion resistance than the body and a relative exposure at least substantially equal to a relative exposure of a plurality of cutting elements disposed on the body;

during rotation, engaging the inner surface of the casing with at least the impact material positioned on the at least one portion of the body; and wearing away the impact material responsive to engagement thereof with the inner surface of the casing as the earth-boring tool cuts into the inner surface of the casing to expose at least one of another cutting structure and the plurality of cutting elements when the earth-boring tool establishes a cutting pattern in the casing.

18. The method of claim 17, wherein directing the rotating earth-boring tool toward the inner surface of the casing comprises employing a whipstock to direct the rotating earth-boring tool toward the inner surface of the casing.

19. The method of claim 17, wherein engaging the inner surface of the casing with the impact material comprises engaging the inner surface of the casing with the impact material positioned on a shoulder region of the body.

20. The method of claim 17, wherein wearing away the impact material to expose at least one of another cutting structure and the plurality of cutting elements when the earth-boring tool establishes the cutting pattern in the casing comprises wearing away the impact material to expose the at least one of another cutting structure and the plurality of cutting elements when the earth-boring tool has cut about 5 inches (12.7 cm) into the casing.

21. The method of claim 17, further comprising continuing to drill into the subterranean formation outside of the casing.

* * * * *